US009080484B2

(12) United States Patent
Miyairi

(10) Patent No.: US 9,080,484 B2
(45) Date of Patent: Jul. 14, 2015

(54) WALL FLOW TYPE EXHAUST GAS PURIFICATION FILTER

(71) Applicant: NGK Insulators, Ltd., Nagoya (JP)

(72) Inventor: Yukio Miyairi, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 14/228,810

(22) Filed: Mar. 28, 2014

(65) Prior Publication Data

US 2014/0298779 A1 Oct. 9, 2014

(30) Foreign Application Priority Data

Apr. 4, 2013 (JP) ..... 2013-078981

(51) Int. Cl.
*F01N 3/02* (2006.01)
*F01N 3/035* (2006.01)
*F01N 3/022* (2006.01)

(52) U.S. Cl.
CPC ..... *F01N 3/035* (2013.01); *F01N 3/022* (2013.01); *F01N 2330/34* (2013.01); *F01N 2330/48* (2013.01)

(58) Field of Classification Search
USPC ..... 60/274, 295, 298, 297, 311
See application file for complete search history.

(56) References Cited

U.S. PATENT DOCUMENTS

| | | | | |
|---|---|---|---|---|
| 4,416,676 | A * | 11/1983 | Montierth | 55/523 |
| 4,417,908 | A * | 11/1983 | Pitcher, Jr. | 55/523 |
| 7,314,496 | B2 * | 1/2008 | Hong et al. | 55/523 |
| 8,246,710 | B2 * | 8/2012 | Komori et al. | 55/523 |
| 8,911,849 | B2 * | 12/2014 | Sakamoto et al. | 428/116 |
| 8,945,698 | B2 * | 2/2015 | Kimura et al. | 428/116 |
| 2005/0076627 | A1 | 4/2005 | Itou et al. | |

FOREIGN PATENT DOCUMENTS

| | | | |
|---|---|---|---|
| EP | 2 216 084 | A1 | 8/2010 |
| JP | 2004-000896 | A1 | 1/2004 |
| WO | 2009/069378 | A1 | 6/2009 |

* cited by examiner

*Primary Examiner* — Binh Q Tran
(74) *Attorney, Agent, or Firm* — Burr & Brown, PLLC

(57) ABSTRACT

A wall flow type exhaust gas purification filter includes a honeycomb structure body and plugging portions. Four inlet opening cells having a substantially hexagonal shape in cross section surround one outlet opening cell having a substantially square shape in cross section, where one side of an inlet opening cell and one side of the outlet opening cell have a substantially same length and are substantially parallel and adjacent to each other. Distance a between the partition wall defining a first side of the outlet opening cell and the partition wall defining an opposed second side is in a range of exceeding 0.8 mm and less than 2.4 mm, and distance b between the partition wall defining a third side of the inlet opening cell and the partition wall defining an opposed fourth side has a ratio to the distance a in a range exceeding 0.4 and less than 1.1.

17 Claims, 4 Drawing Sheets

WALL FLOW TYPE EXHAUST GAS PURIFICATION FILTER

The present application is an application based on JP-2013-078981 filed on Apr. 4, 2013 with the Japanese Patent Office, the entire contents of which are incorporated herein by reference.

BACKGROUND OF THE INVENTION

1. Field of the Invention

The present invention relates to a wall flow type exhaust gas purification filter. More particularly, the present invention relates to a wall flow type exhaust gas purification filter suitably used for purifying of particulate matters and noxious gas components such as nitrogen oxide (NOx), carbon monoxide (CO), and hydrocarbon (HC) especially contained in exhaust gas from automobile engines.

2. Background Art

Reduction of fuel consumption by automobiles has been demanded in recent years from the viewpoints of influences on the global environment and resource saving. This leads to the tendency to use internal combustion engines having good heat efficiency such as a direct-injection gasoline engine and a diesel engine more as a power source for automobiles.

These internal combustion engines, however, have a problem of cinder generated during the combustion of fuel. Considering the atmospheric environment, countermeasure is required not to release particulate matters (hereinafter this may be called "PM") such as soot and ashes to the atmosphere while removing noxious components from the exhaust gas.

Regulations on the removal of the PM exhausted from a diesel engine have been made especially tighter on a global basis, and so a honeycomb-structured wall flow type exhaust gas purification filter attracts attention as a collection filter to remove the PM (hereinafter this filter may be called a "DPF"), and various systems have been proposed. The DPF is typically configured to include a plurality of cells as through channels of fluid that are defined and formed by a porous partition wall, where the cells are plugged alternately, whereby the porous partition walls defining the cells serve as a filter.

The DPF is configured to let in exhaust gas or the like containing particulate matters from a first end face (inflow-side end face) to filter the particulate matters with the partition walls, and to let out the purified gas from a second end face (outflow-side end face). Such a DPF has a problem of the particulate matters contained in the flow-in exhaust gas being accumulated on the partition walls, causing the clogging of the inflow-side cells. This often happens in the case of containing a lot of particulate matters in the exhaust gas or in cold climate areas. Such clogging of the cells leads to the problem of abrupt increase in pressure loss at the DPF. Then to suppress such clogging of the cells, the DPF is devised to increase the filtration area and the opening ratio at the inflow-side cells of the exhaust gas.

Specifically, one proposed structure has different cross-sectional areas between the inflow-side cells, i.e., the cells that are open at the inflow-side end face (inlet opening cell) and the outflow-side cells, i.e., the cells that are open at the outflow-side end face (outlet opening cell)(hereinafter this may be called a "High Ash Capacity (HAC) structure") (see Patent Document 1, for example). Herein, the cross-sectional area of a cell refers to the area of a cross section obtained by cutting the cell at a plane perpendicular to the central axis direction.

Another proposed honeycomb filter has such a HAC structure including inflow-side cells having a large cross-sectional area and outflow-side cells having a small cross sectional area, while having different cross-sectional shapes between the inflow-side cells and the outflow-side cells (see Patent Document 2, for example). Herein, the cross-sectional shape of a cell refers to the shape of a cross section obtained by cutting the cell at a plane perpendicular to the central axis direction.

[Patent Document 1] WO 2009/069378

[Patent Document 2] JP-A-2004-000896

SUMMARY OF THE INVENTION

To increase the opening ratio of the inflow-side cells (inlet opening cells), however, means to relatively decrease the opening ratio of the outflow-side cells (outlet opening cells), and accordingly the pressure loss at the initial stage increases unfortunately.

Such different cross-sectional areas and shapes between the inflow-side cells (inlet opening cells) and the outflow-side cells (outlet opening cells) make the partition walls defining the cells partially thin at a part where the adjacent partition walls intersect to each other (hereinafter this may be called an intersecting part), which leads to the lowering in strength at that part. This may lead to a problem that, when the PM accumulated at the DPF is burned for removal by post injection, thermal stress is concentrated on a part of the thin intersecting part, and such a part may easily break due to cracks, for example. Herein, the part where the partition walls of a honeycomb filter such as a DPF intersect (intersecting part) refers to a part belonging to both of the two partition walls mutually intersecting at a cross section that is obtained by cutting the filter at a plane perpendicular to the central axis direction. For instance, when partition walls extending linearly and having the same thickness intersect mutually at the cross section, the intersecting part refers to the range of a square cross-sectional shape at their intersecting part.

In view of such problems of the conventional techniques, it is an object of the present invention to provide a wall flow type exhaust gas purification filter capable of suppressing pressure loss at the initial stage as well as pressure loss at the time of PM accumulated, while preventing local temperature rise of the filter during PM combustion and thus decreasing cracks due to thermal stress.

The present inventors found that the aforementioned problems can be solved by increasing the filtration area and the opening ratio of inflow-side cells (inlet opening cells) while keeping the opening diameter of the outflow-side cells (outlet opening cells) large. That is, the present invention provides the following wall flow type exhaust gas purification filter.

[1] A wall flow type exhaust gas purification filter includes a honeycomb structure body including a porous partition wall defining and forming a plurality of cells as through channels of a fluid, which extend from a first end face to a second end face, and plugging portions disposed at the first end face at a predetermined cell of the plurality of cells and at the second end face at remaining cell. The plurality of cells include an inlet opening cell that is open at an inflow-side end face of the fluid and is provided with an outflow-side plugging portion at an outflow-side end face of the fluid; and an outlet opening cell that is provided with an inflow-side plugging portion at the inflow-side end face and is open at the outflow-side end face. The inlet opening cell has an apparently substantially hexagonal shape in cross section perpendicular to a central axis direction of the honeycomb structure body. The outlet opening cell has a substantially square shape in cross section perpendicular to the central axis direction of the honeycomb structure body. The plurality of cells are configured so that four inlet opening cells surround one outlet opening cell, where one predetermined side of an inlet opening cell and one side of the outlet opening cell adjacent to the predetermined side have a substantially same length and are substantially parallel to each other. Distance a between the partition wall defining a first side of the outlet opening cell and the partition wall defining a second side opposed to the first side of the outlet opening cell is in a range of exceeding 0.8 mm and less than 2.4 mm. Distance b between the partition wall defining a third side of the inlet opening cell, the third side being substantially parallel and adjacent to one side of the outlet opening cell and the partition wall defining a fourth side opposed to the third side of the inlet opening cell has a ratio to the distance a in a range exceeding 0.4 and less than 1.1.

[2] In the wall flow type exhaust gas purification filter according to [1], the inlet opening cell may include a dividing wall so as to connect a central part of the third side and a central part of the fourth side in a direction perpendicular to the central axis direction of the honeycomb structure body.

[3] In the wall flow type exhaust gas purification filter according to [1] or [2], the inlet opening cell may have a geometrical surface area GSA (a value (S/V) obtained by dividing an overall inner surface area (S) of the inlet opening cell by an overall capacity (V) of the honeycomb structure body) that is 10 to 30 $cm^2/cm^3$, the inlet opening cell may have a cell cross-sectional opening ratio of 20 to 70%, and each of the plurality of cells may have a hydraulic diameter of 0.5 to 2.5 mm.

[4] In the wall flow type exhaust gas purification filter according to any one of [1] to [3], the inlet opening cell may have a geometrical surface area GSA (a value (S/V) obtained by dividing an overall inner surface area (S) of the inlet opening cell by an overall capacity (V) of the honeycomb structure body) that is 12 to 18 $cm^2/cm^3$, the inlet opening cell may have a cell cross-sectional opening ratio of 25 to 65%, and each of the plurality of cells may have a hydraulic diameter of 0.8 to 2.2 mm.

[5] In the wall flow type exhaust gas purification filter according to any one of [1] to [4], the plurality of cells each may have corners of a cross section perpendicular to the central axis direction of the honeycomb structure body, the corners having a curved shape with a curvature radius of 0.05 to 0.4 mm.

[6] In the wall flow type exhaust gas purification filter according to any one of [1] to [5], the partition wall defining the plurality of cells may be loaded with catalyst.

The present invention provides a wall flow type exhaust gas purification filter capable of efficiently collecting particulate matters contained in exhaust gas discharged from a direct-injection gasoline engine and a diesel engine for removal, and having less pressure loss at the initial stage as well as during PM accumulation. The wall flow type exhaust gas purification filter of the present invention can effectively prevent cracks and the like generated due to thermal stress concentration during PM combustion as well.

DESCRIPTION OF THE PREFERRED EMBODIMENTS

The following describes embodiments of the present invention, with reference to the drawings. The present invention is not limited to the following embodiments, and changes, modifications and improvements may be made without departing from the scope of the present invention.

Figure 1:
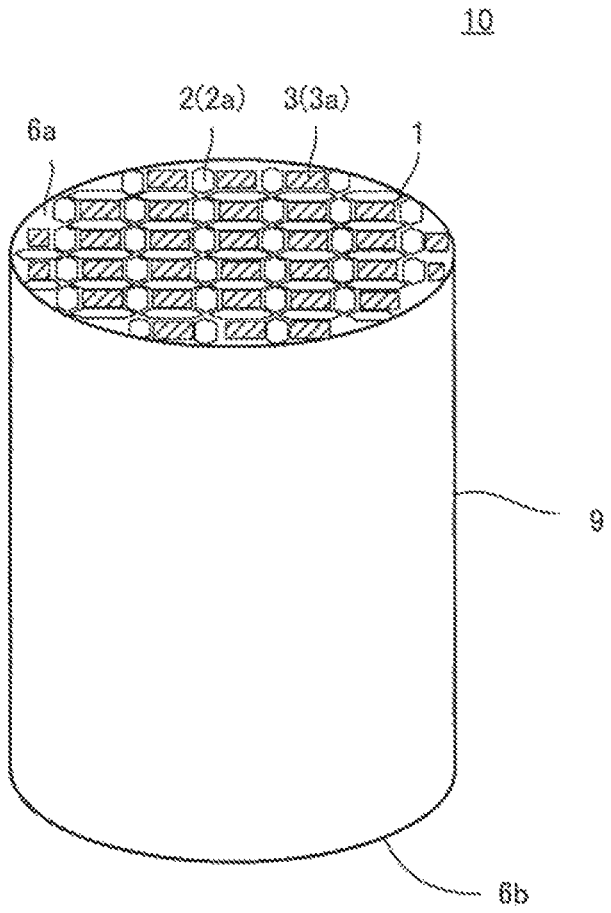
FIG. 1 is a perspective view schematically showing one embodiment of a wall flow type exhaust gas purification filter of the present invention.
Figure 2:
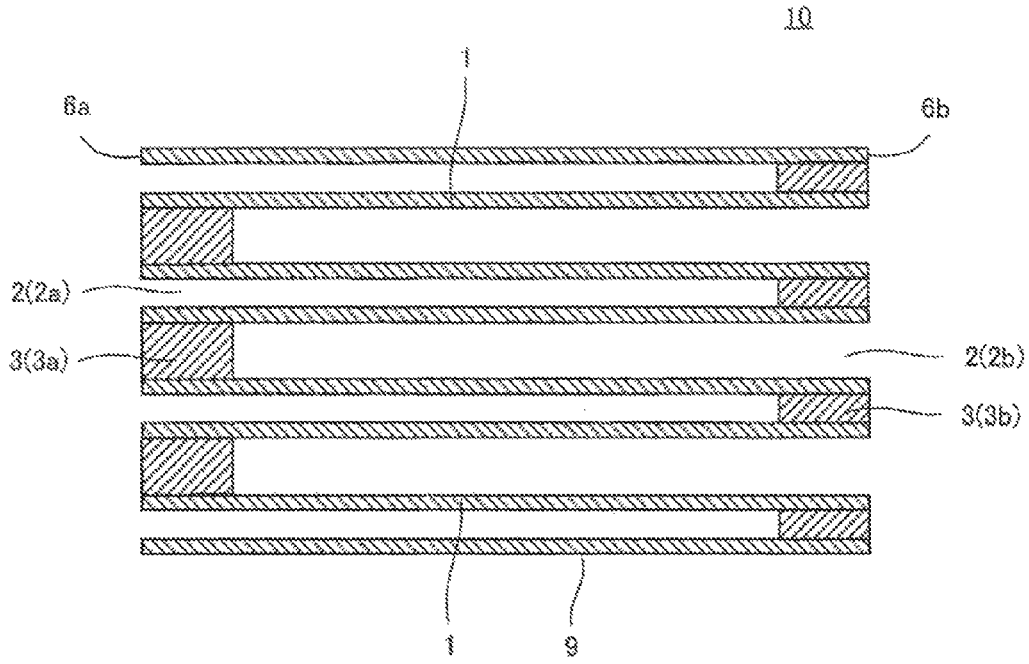
FIG. 2 is a cross-sectional view schematically showing one embodiment of a wall flow type exhaust gas purification filter of the present invention, which shows a cross-section taken along line A-A' in FIGS. 3 and 4.

A wall flow type exhaust gas purification filter of the present invention includes a honeycomb structure body having porous partition walls defining and forming a plurality of cells, which extends from a first end face to a second end face and serving as through channels of fluid, and plugging portions disposed at the first end face of a predetermined cell and at the second end face of remaining cell. FIG. 1 is a perspective view schematically showing one embodiment of a wall flow type exhaust gas purification filter of the present invention. FIG. 2 is a cross-sectional view schematically showing one embodiment of a wall flow type exhaust gas purification filter of the present invention, which shows a cross-section taken along the line A-A' in FIGS. 3 and 4. As illustrated in FIGS. 1 and 2, a wall flow type exhaust gas purification filter 10 of the present invention includes a honeycomb structure body 9 and a plugging portion 3. A plurality of cells 2 include an inlet opening cell 2*a* that is open at an inflow-side end face 6*a* of fluid and is provided with an outflow-side plugging portion 3*b* at an outflow-side end face 6*b* of the fluid, and an outlet opening cell 2*b* that is provided with an inflow-side plugging portion 3*a* at the inflow-side end face 6*a*, and is open at the outflow-side end face 6*b*.

Preferable materials of the honeycomb structure body 9 of the present invention include, but not limited to, an oxide or a non-oxide of various types of ceramic and metal and the like as its main components from the viewpoint of strength, heat resistance, durability and the like. Specifically, they include cordierite, mullite, alumina, spinel, silicon carbide, silicon nitride, aluminum titanate and the like, and exemplary metals include Fe—Cr—Al based metals and metallic silicon. The honeycomb structure body is preferably made of one or two types or more of these materials as its main components. From the viewpoint of high strength, high heat resistance and the like, it especially preferably is made of one or two types or more selected from the group consisting of alumina, mullite, aluminum titanate, cordierite, silicon carbide and silicon nitride. From the viewpoint of high heat conductivity, high heat resistance and the like, silicon carbide or a silicon-silicon carbide composite material is especially suitable. Herein, the "main components" mean that such components make up 50 mass % or more of the honeycomb structure body, preferably 70 mass % or more and more preferably 80 mass % or more.

Preferable materials of the plugging portion 3 of the present invention include, but not especially limited to, one type or two types or more selected from various types of ceramic and metal and the like that are described above as preferable materials of the honeycomb structure body 9.

The wall flow type exhaust gas purification filter 10 of the present invention may include the integration of a plurality of segments or a slit formed therein. The thus manufactured wall flow type exhaust gas purification filter 10 can distribute thermal stress applied to the filter, thus preventing cracks due to local temperature rise.

Although there is no limitation on the size and the shape of each segment for integration of a plurality of honeycomb segments, a too large segment is not preferable because the effect to prevent cracks by segmentation is not sufficient, and a too small segment also is not preferable because it makes the manufacturing process of each segment and the integration process by bonding complicated. Exemplary shapes of such honeycomb segments include, but not especially limited to, a quadrangular shape in cross section, i.e., a quadrangular prism as the shape of the segment as a basic shape, and the outer peripheral shape of the wall flow type exhaust gas purification filter 10 after integration may be selected and processed appropriately. There is no particular limitation on the overall shape of the wall flow type exhaust gas purification filter 10 of the present invention, which may be a circular shape in cross section as shown in FIG. 1, or may be a substantially circular shape such as an oval shape, a race-track shape or an oblong shape as well as a polygonal shape such as a quadrangular shape or a hexagonal shape.

Figure 3:
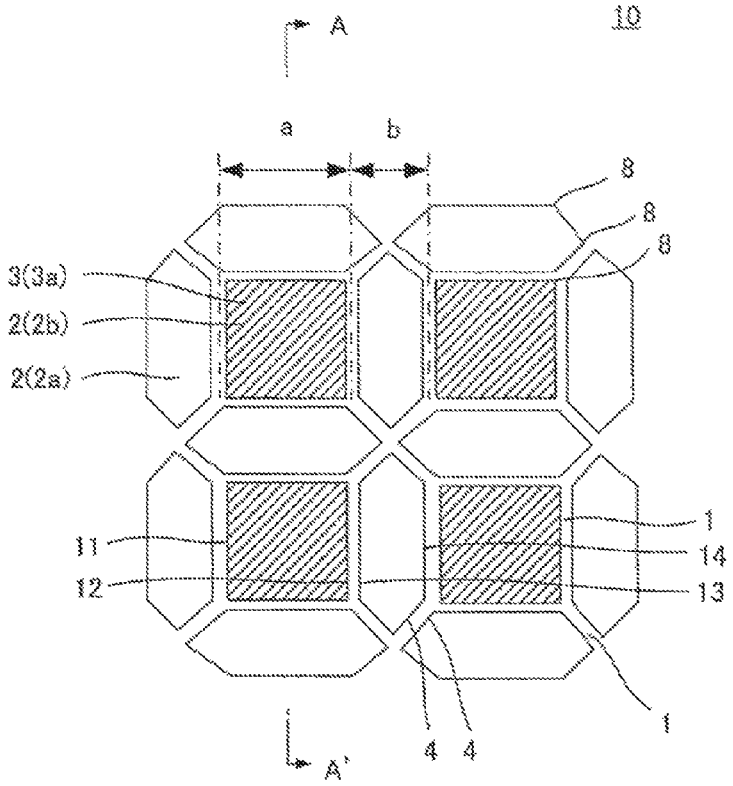
FIG. 3 is a partially enlarged view schematically showing one embodiment of the wall flow type exhaust gas purification filter of the present invention viewed from the inflow side.
Figure 4:
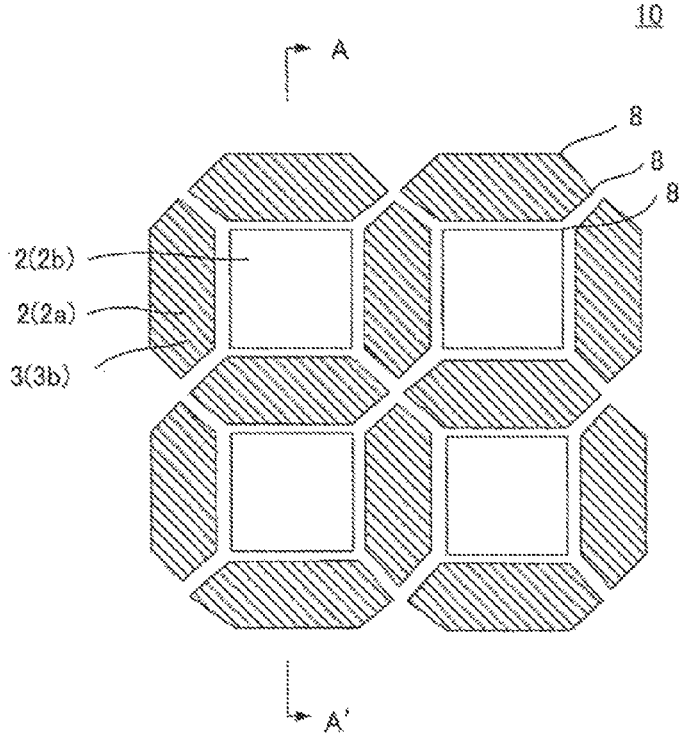
FIG. 4 is a partially enlarged view schematically showing one embodiment of the wall flow type exhaust gas purification filter of the present invention viewed from the outflow side.
Figure 6:
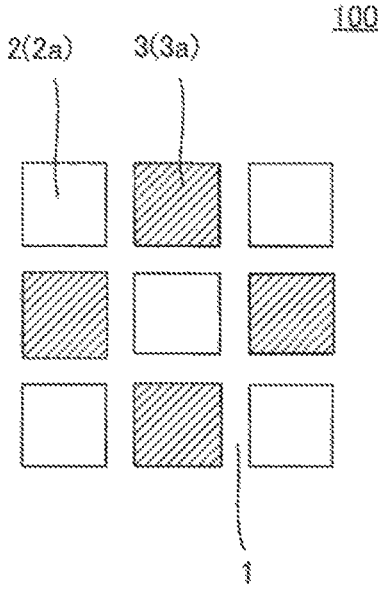
FIG. 6 is a cross sectional view schematically showing one embodiment of a conventional wall flow type exhaust gas purification filter.

FIG. 3 is a partially enlarged view schematically showing one embodiment of the wall flow type exhaust gas purification filter of the present invention viewed from the inflow side. FIG. 4 is a partially enlarged view schematically showing one embodiment of the wall flow type exhaust gas purification filter of the present invention viewed from the outflow side. As shown in FIGS. 3 and 4, an inlet opening cell 2*a* of the wall flow type exhaust gas purification filter 10 of the present invention has an apparently substantially hexagonal shape in cross section perpendicular to the central axis direction of the honeycomb structure body 9. An outlet opening cell 2*b* has a substantially square shape in cross section perpendicular to the central axis direction of the honeycomb structure body 9. FIG. 6 is a cross sectional view schematically showing one embodiment of a conventional wall flow type exhaust gas purification filter. In the embodiment of FIG. 6, both of the inlet opening cell 2*a* and the outlet opening cell 2*b* (corresponding to the inflow-side plugging portion 3*a* in FIG. 6) have a substantially square shape in cross section. The inlet opening cell 2*a* of the wall flow type exhaust gas purification filter 10 of the present invention has a substantially hexagonal shape in cross section, whereby as compared with the conventional wall flow type exhaust gas purification filter 100 as shown in FIG. 6, the filtration area of the filter can be made larger, and so pressure loss due to PM accumulated can be decreased. Herein, the "shape in cross section" means a shape of a cross section obtained by cutting the cell 2 at a plane perpendicular to the central axis direction, and is a shape of the part surrounded with a partition wall 1 defining the cell 2. The present specification refers to an inlet opening cell 2*a* as having an "apparently" substantially hexagonal shape as long as the part surrounded with the partition wall 1 has a substantially hexagonal shape even when the inlet opening cell 2*a* is divided into a plurality of spaces.

As shown in FIGS. 3 and 4, the plurality of cells 2 of the wall flow type exhaust gas purification filter 10 of the present invention is configured so that four inlet opening cells 2*a* surround one outlet opening cell 2*b*, where one predetermined side of an inlet opening cell 2*a* and one side of the outlet opening cell 2*b* adjacent to the predetermined side have a substantially same length and are substantially parallel to each other. That is, each of the four sides of the outlet opening cell 2*b* having a substantially square shape in cross section is adjacent to one side of an inlet opening cell 2*a* having a substantially hexagonal shape in cross section, where these adjacent sides have a substantially same length and are substantially parallel to each other. In such a structure, the outlet opening cells 2*b* are not adjacent to each other, and all the periphery of each outlet opening cell 2*b* is surrounded with four inlet opening cells 2*a*. Such a structure can increase the opening ratio of the outlet opening cell 2*b* and can make the number of the outlet opening cells 2*b* less than the number of the inlet opening cells 2*a*, whereby pressure loss at the initial stage can be decreased.

As shown in FIGS. 3 and 4, four sides 4 of the six sides of an inlet opening cell 2*a* other than two sides 13 and 14 that are adjacent to and substantially parallel to an outlet opening cell 2*b* are adjacent to sides 4 of another inlet opening cell 2*a* next to the outlet opening cell 2*b*. That is, at a part where four apexes of two adjacent sides 4 of each inlet opening cell 2*a* meet, as shown in FIGS. 3 and 4, two partition walls 1 mutually intersect at right angles. Such a structure can keep heat capacity of the partition walls 1 high, and so thermal stress applied to the apex part where PM easily accumulates during PM combustion can be alleviated.

Distance a between a partition wall 1 defining a first side 11 of an outlet opening cell 2*b* and a partition wall 1 defining a second side 12 opposed to the first side 11 of the outlet opening cell 2*b* is preferably in the range exceeding 0.8 mm and less than 2.4 mm. Herein, the distance a refers to the shortest distance from the center in the thickness direction of the partition wall 1 defining the first side 11 to the center in the thickness direction of the partition wall 1 defining the opposed second side 12. Distance b between a partition wall 1 defining the third side 13 of an inlet opening cell 2*a* that is substantially parallel and adjacent to one side of an outlet opening cell 2*b* and a partition wall 1 defining the fourth side 14 opposed to the third side 13 of the inlet opening cell 2*a* preferably has a ratio to the distance a in the range exceeding 0.4 and less than 1.1. Herein, the distance b refers to the shortest distance from the center in the thickness direction of the partition wall 1 defining the third side 13 to the center in the thickness direction of the partition wall 1 defining the opposed fourth side 14. Relationships of the distance a and the distance b in the above range are preferable, because they can decrease pressure loss at the initial stage and pressure loss during PM accumulation while keeping them in balance.

There is no particular limitation on the method for manufacturing the wall flow type exhaust gas purification filter 10 of the present invention, and it can be manufactured by the following method, for example. A material selected from the aforementioned suitable materials, e.g., silicon carbide powder, is used as raw material powder of the honeycomb structure body 9, to which binder such as methyl cellulose or hydroxypropoxyl methylcellulose is added, and surfactant and water are further added, thus preparing a kneaded material having plasticity. The kneaded material is then subjected to extrusion, thus obtaining a formed body of the honeycomb structure body 9 having the partition wall 1 and the cells 2 of the aforementioned predetermined cross-sectional shapes. The formed body is then dried by microwaves and hot air, and then plugging portions 3 are disposed by plugging using the same material as that of the honeycomb structure body 9. This is further dried, and then is subjected to degreasing by heating in a nitrogen atmosphere, for example, and is fired in an inert atmosphere such as argon, whereby a wall flow type exhaust gas purification filter 10 of the present invention can be obtained. The firing temperature and the atmosphere for firing depend on the raw materials used, and a person skilled in the art could select appropriate temperature and atmosphere for firing depending on the selected materials.

The wall flow type exhaust gas purification filter 10 of the present invention may have the structure including the integration of a plurality of honeycomb segments by the following method, for example. A plurality of honeycomb segments may be bonded mutually with ceramic cement, for example, followed by drying and curing, which is then processed in its outer periphery to have a desired shape, whereby a segment-integrated type wall flow type exhaust gas purification filter 10 can be obtained.

Figure 5:
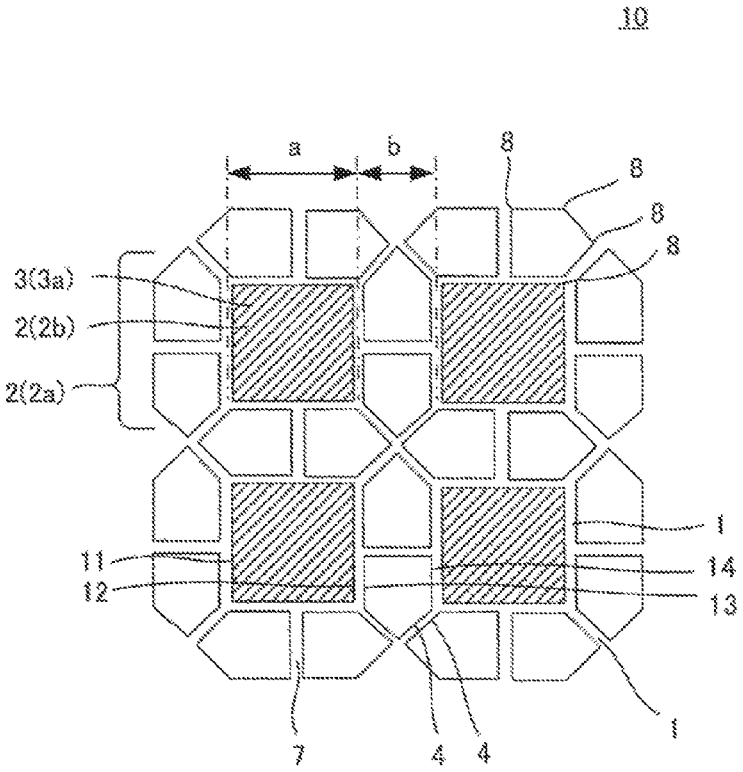
FIG. 5 is a partially enlarged view schematically showing another embodiment of the wall flow type exhaust gas purification filter of the present invention viewed from the inflow side.

FIG. 5 is a partially enlarged view schematically showing another embodiment of the wall flow type exhaust gas purification filter of the present invention viewed from the inflow side. As shown in FIG. 5, the wall flow type exhaust gas purification filter 10 of the present invention may include a dividing wall 7 that divides an inlet opening cell 2*a* in the central axis direction. Such a dividing wall 7 formed can increase the filtration area at the inlet opening cell 2*a*. There is no particular limitation on the shape, the number and the positions of the dividing wall 7, and as in the embodiment shown in FIG. 5, the dividing wall 7 is preferably formed so as to connect the central part of the third side 13 and the central part of the fourth side 14 at the inlet opening cell 2*a* in the direction perpendicular to the central axis direction of the inlet opening cell 2*a*. The inlet opening cell 2*a* in such an embodiment is divided into two spaces, each having a substantially pentagonal shape in cross section, by the dividing wall 7.

There is no particular limitation on materials of the dividing wall 7, which may be selected appropriately from porous materials having filtration ability. In view of the easiness to manufacture the filter, the same material as that of the partition wall 1 is preferably used. There is no particular limitation on the thickness of the dividing wall 7 as well, and the thickness is preferably in the range of 0.1 to 0.5 mm from the viewpoint of heat capacity and strength. A thickness less than 0.1 mm is not preferable from the viewpoint of heat capacity and strength. A thickness larger than 0.5 mm is not preferable because it cannot achieve sufficient filtration area. The present specification considers the inlet opening cell 2*a* as having an "apparently" substantially hexagonal shape even with the dividing wall 7.

In the wall flow type exhaust gas purification filter 10 of the present invention, the inlet opening cell 2*a* preferably has a geometrical surface area GSA (a value (S/V) obtained by dividing the overall inner surface area (S) of the inlet opening cell 2*a* by the overall capacity (V) of the honeycomb structure body 9) that is 10 to 30 $cm^2/cm^3$, and 12 to 18 $cm^2/cm^3$ more preferably. Typically a larger filtration area of a filter means lower pressure loss because the thickness of PM accumulated on a partition wall can be reduced. A geometrical surface area GSA of the inlet opening cell 2*a* less than 10 $cm^2/cm^3$ is not preferable because it leads to an increase in pressure loss during PM accumulation. A geometrical surface area larger than 30 $cm^2/cm^3$ is also not preferable because pressure loss at the initial stage increases.

In the wall flow type exhaust gas purification filter 10 of the present invention, the inlet opening cell 2*a* preferably has a cell cross-sectional opening ratio of 20 to 70%, and 25 to 65% more preferably. A cell cross-sectional opening ratio of the inlet opening cell 2*a* less than 20% is not preferable because pressure loss at the initial stage increases. A cell cross-sectional opening ratio of the inlet opening cell 2*a* larger than 70% is not preferable because it increases the flowing rate of the filtration and so decreases the collecting efficiency of PM, and further the strength of the partition wall 1 becomes insufficient. Herein, the "cell cross-sectional opening ratio of the inlet opening cell 2*a*" means a ratio of the "total sum of the cross sectional area of the inlet opening cells 2*a*" with respect to the total of the "cross-sectional area of the partition wall 1 as a whole constituting the honeycomb structure body 9" and "the total sum of the cross-sectional areas of all cells 2" at a cross section perpendicular to the central axis direction of the honeycomb structure body 9.

In the wall flow type exhaust gas purification filter 10 of the present invention, each of the plurality of cells 2 preferably has a hydraulic diameter of 0.5 to 2.5 mm, and 0.8 to 2.2 mm more preferably. A hydraulic diameter of each cell 2 less than 0.5 mm is not preferable because pressure loss at the initial stage increases. A hydraulic diameter of each cell 2 larger than 2.5 mm is not preferable because the contact area of the exhaust gas with the partition wall 1 decreases and so the purification efficiency deteriorates. Herein, the hydraulic diameter of each of the plurality of cells 2 is a value calculated based on a cross-sectional area and the peripheral length of each cell 2 by 4×(cross-sectional area)/(peripheral length). The cross-sectional area of each cell 2 is an area of a shape of the cell (cross-sectional shape) at a cross section perpendicular to the central axis direction of the honeycomb structure body 9, and the periphery length of the cell is a length of the periphery of the cross-sectional shape of the cell (the length of closed line surrounding the cross section).

Considering tradeoff among pressure loss at the initial stage, pressure loss during PM accumulation and collecting efficiency, the wall flow type exhaust gas purification filter 10 of the present invention preferably satisfies all of the followings: the geometrical surface GSA of the inlet opening cell 2*a* that is 10 to 30 $cm^2/cm^3$; the cell cross-sectional opening ratio of the inlet opening cell 2*a* that is 20 to 70%; and the hydraulic diameter of each of the plurality of cells 2 that is 0.5 to 2.5 mm at the same time. More preferably it satisfies all of the followings: the geometrical surface GSA of the inlet opening cell 2*a* that is 12 to 18 $cm^2/cm^3$; the cell cross-sectional opening ratio of the inlet opening cell 2*a* that is 25 to 65%, and the hydraulic diameter of each of the plurality of cells 2 that is 0.8 to 2.2 mm at the same time.

Corners 8 of the plurality of cells 2 at a cross section perpendicular to the central axis direction of the honeycomb structure body 9, i.e., six corners of the substantially hexagonal-shaped cross section of the inlet opening cell 2*a* as well as four corners of the substantially square-shaped cross section of the outlet opening cell 2*b* preferably have a curved shape having R. Specifically, the corners 8 preferably have a curved shape having a curvature radius of 0.05 to 0.4 mm, and more preferably has a curved shape having a curvature radius of 0.2 to 0.4 mm from the viewpoint to prevent stress concentration. A curvature radius of the corners 8 less than 0.05 mm is not preferable because PM easily accumulates at the corners 8 in such a dimension and thermal stress and strength of the partition wall 1 deteriorate at the same time, and so the effect to alleviate thermal stress cannot be sufficient. A curvature radius of the corners 8 larger than 0.4 mm is not preferable because the filtration area of the cells decreases.

In the wall flow type exhaust gas purification filter 10 of the present invention, the partition walls 1 defining a plurality of cells 2 may be loaded with catalyst. The partition walls 1 loaded with catalyst means that inner walls of pores formed at the surface of the partition walls 1 and in the partition wall 1 are coated with the catalyst. Exemplary types of catalyst include SCR catalyst (zeolite, titania, vanadium), at least two types of noble metals of Pt, Rh, and Pd, and ternary catalyst containing at least one type of alumina, ceria, and zirconia. Loading with such catalyst enables detoxication of NOx, CO, HC and the like contained in exhaust gas emitted from a direct-injection gasoline engine and a diesel engine, and facilitates combustion of the PM accumulated at the surface of the partition wall 1 for removal due to the catalyst action.

The method for loading of such catalyst at the wall flow type exhaust gas purification filter 10 of the present invention is not limited especially, and a method typically performed by a person skilled in the art can be used. Specifically, catalyst slurry may be wash-coated, followed by drying and firing, for example.

EXAMPLES

The following describes the present invention in more details by way of examples, and the present invention is not limited to the following examples.

Example 1

As a ceramic raw material, silicon carbide (SiC) powder and metallic silicon (Si) powder were mixed at the mass ratio of 80:20. Hydroxypropylmethyl cellulose as binder and water-absorbable resin as a pore forming member were added to this mixed raw material, to which water was further added, thus manufacturing a forming raw material. Then, the obtained forming raw material was kneaded by a kneader, thus preparing a kneaded material.

Next, the obtained kneaded material was formed by a vacuum extruder, whereby sixteen pieces of quadrangular prism-shaped honeycomb segments having a cell cross-sectional structure shown in FIGS. 3 and 4 were prepared. A honeycomb segment had a cross-section measuring 36 mm×36 mm and had a length of 152 mm. Distance a shown in FIG. 3 was 2.2 mm, and distance b was 1.76 mm. The partition walls had a thickness of 0.2 mm.

Subsequently the thus obtained honeycomb segments were dried by high-frequency dielectric heating and then dried at 120° C. for 2 hours by a hot-air drier. The drying was performed so that the outflow-side end face 6*b* of the honeycomb segments was directed vertically downward.

Plugging portions 3 were formed at the dried honeycomb segments. Firstly, a mask was applied to the inflow-side end face 6*a* of the honeycomb segments, and the masked end part (inflow-side end part) was immersed in slurry for plugging to fill an open frontal area of a cell 2 without a mask (inlet opening cell 2*a*) with the slurry for plugging, thus forming a plugging portion 3 (inflow-side plugging portion 3*a*). Then, a plugging portion 3 (outflow-side plugging portion 3*b*) was similarly formed at remaining cell (i.e., a cell 2 that was not plugged at the inflow-side end face 6*a* (outlet opening cell 2*b*)) at the outflow-side end face 6*b* of the dried honeycomb segments.

Then the honeycomb segments having the plugging portions 3 formed therein were subjected to degreasing and firing, whereby plugged honeycomb segments were obtained. The degreasing was performed at 550° C. for 3 hours, and the firing was performed at 1,450° C. for 2 hours in an argon atmosphere. The firing was performed so that the outflow-side end face 6*b* of the honeycomb segments was directed vertically downward.

The sixteen pieces of honeycomb segments after firing were bonded with a bonding material (ceramic cement) for integration. The bonding material contained inorganic particles and inorganic adhesive as main components and organic binder, surfactant, resin balloon, water and the like as accessory components. The inorganic particles used were plate-like particles, and the inorganic adhesive used was colloidal silica (silica sol). The plate-like particles used were mica. The outer periphery of the bonded honeycomb segment assembly including the sixteen pieces of honeycomb segments bonded for integration was ground to be a cylindrical shape, and a coating material was applied to the outer peripheral face thereof, thus obtaining a finished body. The coating material contained ceramic powder, water and binder.

Through this process, the wall flow type exhaust gas purification filter 10 of Example 1 having a cell cross-sectional structure shown in FIGS. 3 and 4 was manufactured.

Examples 2 to 24

Comparative Examples 1 to 4

Wall flow type exhaust gas purification filters 10 as Examples 2 to 24 and Comparative examples 1 to 4 were manufactured similarly to Example 1 except that distance a, distance b and the thickness of partition walls were set as shown in Table 1.

Comparative Examples 5 to 8

Wall flow type exhaust gas purification filters 100 as Comparative examples 5 to 8 having a cell cross-sectional shape shown in FIG. 6 were manufactured similarly to Example 1 except that dies used for extrusion had different shapes. The cell pitch and the thickness of the partition walls were as shown in Table 1. Herein the cell pitch is a length obtained by adding a thickness of the partition wall to a distance between two opposed sides of a cell 2 having a substantially square-shaped cross-sectional shape.

The wall flow type exhaust gas purification filters as Examples 1 to 24 and Comparative examples 1 to 8 were attached to an exhaust pipe of a diesel engine, and pressure loss at the initial stage, pressure loss during PM accumulation and crack limit were measured for evaluation. Table 1 shows the results.

(Method to Measure Initial Pressure Loss)

Air at 200° C. was allowed to flow through a filter at 2.4 $Nm^3$/min, and pressure loss at initial stage (initial pressure loss) was measured based on a difference in pressure between the inflow side and the outflow side. The initial pressure loss was determined as bad for 2.1 kPa or more, as acceptable for 1.9 kPa or more and less than 2.1 kPa, as good for 1.7 kPa or more and less than 1.9 kPa, and as excellent for less than 1.7 kPa.

(Method to Measure Pressure Loss During PM Accumulation)

Soot was generated by the combustion of diesel oil in the state of lack of oxygen. To the combustion gas at the soot generation amount of 10 g/h and the flow rate of 2.4 $Nm^3$/min and at 200° C., dilution air was added for adjustment, thus preparing soot-containing combustion gas, and such gas was allowed to flow into a filter. Based on a difference in pressure between the inflow side and the outflow side when the soot accumulation amount to the filter reaches 4 g/L, pressure loss during PM accumulation was measured. The pressure loss during PM accumulation was determined as bad for 6.9 kPa or more, as acceptable for 6.5 kPa or more and less than 6.9 kPa, as good for 6.3 kPa or more and less than 6.5 kPa, and as excellent for less than 6.3 kPa.

(Method to Measure Crack Limit)

A filter was mounted to an exhaust system of a diesel engine for a passenger vehicle with a piston displacement of 2 liters, and soot was allowed to accumulate to the filter. Next, the temperature of the exhaust gas was allowed to rise to 650° C., and then the operation mode was changed to the idling operation mode so as to abruptly decrease the gas flow rate for soot regeneration. This test was repeated while changing the amount of soot accumulation to examine the minimum soot accumulation amount when a crack occurred at the filter. Such an amount of soot accumulation was defined as crack limit, and the crack limit was measured. The crack limit was determined as bad for less than 8 g/L, as acceptable for 8 g/L or more and less than 9 g/L, as good for 9 g/L or more and less than 10 g/L, and as excellent for 10 g/L or more.

Comparative Example 25

A wall flow type exhaust gas purification filter 10 as Comparative example 25 having a cell cross-sectional shape shown in FIG. 5 was manufactured similarly to Example 1 except that dies used for extrusion had a different shape. Distance a shown in FIG. 5 was 2.2 mm, and distance b was 1.76 mm. The partition wall had a thickness of 0.2 mm. Then, the dividing wall had a thickness of 0.15 mm.

Examples 26 to 51

Comparative Examples 9 to 15

Wall flow type exhaust gas purification filters 10 as Examples 26 to 51 and Comparative examples 9 to 15 were manufactured similarly to Example 25 except that distance a, distance b and the thickness of partition walls were set as shown in Table 2.

The wall flow type exhaust gas purification filters 10 as Examples 25 to 51 and Comparative examples 9 to 15 were attached to an exhaust pipe of a diesel engine, and pressure loss at the initial stage and pressure loss during PM accumulation were measured for evaluation. Table 2 shows the results.

TABLE 1

| | Cell cross-sectional structure | Dividing wall | Distance a [mm] | Distance b [mm] | b/a | Cell pitch [mm] | Partition wall thickness [mm] | Initial pressure loss | PM accumulation pressure loss | Crack limit | Overall rating |
|---|---|---|---|---|---|---|---|---|---|---|---|
| Comp. Ex. 1 | FIGS. 3, 4 | No* | 2.4 | 1.92 | 0.80 | — | 0.2 | Good | Bad | Good | Bad |
| Ex. 1 | FIGS. 3, 4 | No* | 2.2 | 1.76 | 0.80 | — | 0.2 | Good | Acceptable | Good | Good |
| Ex. 2 | FIGS. 3, 4 | No* | 2 | 1.6 | 0.80 | — | 0.2 | Excellent | Acceptable | Good | Good |
| Ex. 3 | FIGS. 3, 4 | No* | 1.8 | 1.44 | 0.80 | — | 0.2 | Excellent | Acceptable | Good | Good |
| Ex. 4 | FIGS. 3, 4 | No* | 1.8 | 1.08 | 0.60 | — | 0.2 | Excellent | Acceptable | Good | Good |
| Comp. Ex. 2 | FIGS. 3, 4 | No* | 1.5 | 1.65 | 1.10 | — | 0.2 | Bad | Acceptable | Good | Bad |
| Ex. 5 | FIGS. 3, 4 | No* | 1.5 | 1.5 | 1.00 | — | 0.2 | Acceptable | Acceptable | Good | Acceptable |
| Ex. 6 | FIGS. 3, 4 | No* | 1.5 | 1.35 | 0.9 | — | 0.2 | Acceptable | Good | Good | Acceptable |
| Ex. 7 | FIGS. 3, 4 | No* | 1.5 | 1.2 | 0.80 | — | 0.2 | Good | Good | Good | Good |
| Ex. 8 | FIGS. 3, 4 | No* | 1.5 | 1.05 | 0.70 | — | 0.2 | Good | Good | Good | Good |
| Ex. 9 | FIGS. 3, 4 | No* | 1.5 | 0.9 | 0.60 | — | 0.2 | Good | Good | Good | Good |
| Ex. 10 | FIGS. 3, 4 | No* | 1.5 | 1.35 | 0.9 | — | 0.152 | Good | Good | Good | Good |
| Ex. 11 | FIGS. 3, 4 | No* | 1.5 | 1.2 | 0.80 | — | 0.152 | Good | Good | Good | Good |
| Ex. 12 | FIGS. 3, 4 | No* | 1.5 | 1.05 | 0.70 | — | 0.152 | Good | Good | Good | Good |
| Ex. 13 | FIGS. 3, 4 | No* | 1.5 | 0.9 | 0.60 | — | 0.152 | Good | Good | Good | Good |
| Ex. 14 | FIGS. 3, 4 | No* | 1.4 | 1.26 | 0.90 | — | 0.152 | Good | Acceptable | Good | Acceptable |
| Ex. 15 | FIGS. 3, 4 | No* | 1.4 | 1.12 | 0.80 | — | 0.152 | Good | Acceptable | Good | Acceptable |
| Ex. 16 | FIGS. 3, 4 | No* | 1.4 | 0.98 | 0.70 | — | 0.152 | Good | Acceptable | Good | Acceptable |
| Ex. 17 | FIGS. 3, 4 | No* | 1.4 | 0.84 | 0.60 | — | 0.152 | Good | Acceptable | Good | Acceptable |
| Ex. 18 | FIGS. 3, 4 | No* | 1.3 | 1.17 | 0.90 | — | 0.152 | Good | Acceptable | Good | Acceptable |
| Ex. 19 | FIGS. 3, 4 | No* | 1.3 | 1.04 | 0.80 | — | 0.152 | Good | Acceptable | Good | Acceptable |
| Ex. 20 | FIGS. 3, 4 | No* | 1.3 | 0.91 | 0.70 | — | 0.152 | Good | Acceptable | Good | Acceptable |
| Ex. 21 | FIGS. 3, 4 | No* | 1.3 | 0.78 | 0.60 | — | 0.152 | Good | Acceptable | Good | Acceptable |
| Ex. 22 | FIGS. 3, 4 | No* | 1.3 | 0.715 | 0.55 | — | 0.152 | Good | Acceptable | Good | Acceptable |
| Ex. 23 | FIGS. 3, 4 | No* | 1.3 | 0.65 | 0.50 | — | 0.152 | Good | Acceptable | Good | Acceptable |
| Ex. 24 | FIGS. 3, 4 | No* | 1.2 | 0.6 | 0.50 | — | 0.152 | Good | Acceptable | Good | Acceptable |
| Comp. Ex. 3 | FIGS. 3, 4 | No* | 1.2 | 0.48 | 0.40 | — | 0.152 | Bad | Bad | Good | Bad |
| Comp. Ex. 4 | FIGS. 3, 4 | No* | 0.8 | 0.64 | 0.80 | — | 0.152 | Bad | Bad | Good | Bad |
| Comp. Ex. 5 | FIG. 6 | No* | — | — | — | 1.4 | 0.152 | Bad | Bad | Bad | Bad |
| Comp. Ex. 6 | FIG. 6 | No* | — | — | — | 1.5 | 0.152 | Bad | Bad | Bad | Bad |
| Comp. Ex. 7 | FIG. 6 | No* | — | — | — | 1.8 | 0.2 | Bad | Bad | Bad | Bad |
| Comp. Ex. 8 | FIG. 6 | No* | — | — | — | 2 | 0.2 | Bad | Bad | Bad | Bad |

No* means without dividing wall

TABLE 2

| | Cell cross-sectional structure | Dividing wall | Distance a [mm] | Distance b [mm] | b/a | Partition wall thickness [mm] | Initial pressure loss | PM accumulation pressure loss | Overall rating |
|---|---|---|---|---|---|---|---|---|---|
| Comp. Ex. 9 | FIG. 5 | Yes* | 2.4 | 1.92 | 0.80 | 0.2 | Good | Bad | Bad |
| Ex. 25 | FIG. 5 | Yes* | 2.2 | 1.76 | 0.80 | 0.2 | Good | Good | Good |
| Ex. 26 | FIG. 5 | Yes* | 2 | 1.6 | 0.80 | 0.2 | Excellent | Good | Good |
| Ex. 27 | FIG. 5 | Yes* | 1.8 | 1.44 | 0.80 | 0.2 | Excellent | Good | Good |
| Ex. 28 | FIG. 5 | Yes* | 1.8 | 1.26 | 0.70 | 0.2 | Excellent | Good | Good |

TABLE 2-continued

| | Cell cross-sectional structure | Dividing wall | Distance a [mm] | Distance b [mm] | b/a | Partition wall thickness [mm] | Initial pressure loss | PM accumulation pressure loss | Overall rating |
|---|---|---|---|---|---|---|---|---|---|
| Comp. Ex. 10 | FIG. 5 | Yes* | 1.5 | 1.65 | 1.10 | 0.2 | Bad | Acceptable | Bad |
| Ex. 29 | FIG. 5 | Yes* | 1.5 | 1.5 | 1.00 | 0.2 | Acceptable | Acceptable | Acceptable |
| Ex. 30 | FIG. 5 | Yes* | 1.5 | 1.35 | 0.9 | 0.2 | Acceptable | Excellent | Acceptable |
| Ex. 31 | FIG. 5 | Yes* | 1.5 | 1.2 | 0.80 | 0.2 | Good | Excellent | Good |
| Ex. 32 | FIG. 5 | Yes* | 1.5 | 1.05 | 0.70 | 0.2 | Good | Excellent | Good |
| Ex. 33 | FIG. 5 | Yes* | 1.5 | 0.9 | 0.60 | 0.2 | Good | Excellent | Good |
| Ex. 34 | FIG. 5 | Yes* | 1.5 | 1.35 | 0.9 | 0.152 | Good | Excellent | Good |
| Ex. 35 | FIG. 5 | Yes* | 1.5 | 1.2 | 0.80 | 0.152 | Good | Excellent | Good |
| Ex. 36 | FIG. 5 | Yes* | 1.5 | 1.05 | 0.70 | 0.152 | Good | Excellent | Good |
| Ex. 37 | FIG. 5 | Yes* | 1.5 | 0.9 | 0.60 | 0.152 | Good | Excellent | Good |
| Ex. 38 | FIG. 5 | Yes* | 1.4 | 1.12 | 0.80 | 0.152 | Good | Good | Acceptable |
| Ex. 39 | FIG. 5 | Yes* | 1.4 | 0.98 | 0.70 | 0.152 | Good | Good | Acceptable |
| Ex. 40 | FIG. 5 | Yes* | 1.4 | 0.84 | 0.60 | 0.152 | Good | Good | Acceptable |
| Ex. 41 | FIG. 5 | Yes* | 1.3 | 1.17 | 0.90 | 0.152 | Good | Good | Acceptable |
| Ex. 42 | FIG. 5 | Yes* | 1.3 | 1.04 | 0.80 | 0.152 | Good | Good | Acceptable |
| Ex. 43 | FIG. 5 | Yes* | 1.3 | 0.91 | 0.70 | 0.152 | Good | Good | Acceptable |
| Ex. 44 | FIG. 5 | Yes* | 1.3 | 0.78 | 0.60 | 0.152 | Good | Good | Acceptable |
| Ex. 45 | FIG. 5 | Yes* | 1.3 | 0.715 | 0.55 | 0.152 | Good | Good | Acceptable |
| Ex. 46 | FIG. 5 | Yes* | 1.3 | 0.65 | 0.50 | 0.152 | Good | Good | Acceptable |
| Ex. 47 | FIG. 5 | Yes* | 1.2 | 0.6 | 0.50 | 0.152 | Acceptable | Acceptable | Acceptable |
| Comp. Ex. 11 | FIG. 5 | Yes* | 1.2 | 0.48 | 0.40 | 0.152 | Bad | Bad | Bad |
| Ex. 48 | FIG. 5 | Yes* | 0.9 | 0.81 | 0.90 | 0.152 | Acceptable | Acceptable | Acceptable |
| Ex. 49 | FIG. 5 | Yes* | 0.9 | 0.72 | 0.80 | 0.152 | Acceptable | Acceptable | Acceptable |
| Ex. 50 | FIG. 5 | Yes* | 0.9 | 0.63 | 0.70 | 0.152 | Acceptable | Acceptable | Acceptable |
| Ex. 51 | FIG. 5 | Yes* | 0.9 | 0.54 | 0.60 | 0.152 | Acceptable | Acceptable | Acceptable |
| Comp. Ex. 12 | FIG. 5 | Yes* | 0.8 | 0.72 | 0.90 | 0.152 | Bad | Bad | Bad |
| Comp. Ex. 13 | FIG. 5 | Yes* | 0.8 | 0.64 | 0.80 | 0.152 | Bad | Bad | Bad |
| Comp. Ex. 14 | FIG. 5 | Yes* | 0.8 | 0.56 | 0.70 | 0.152 | Bad | Bad | Bad |
| Comp. Ex. 15 | FIG. 5 | Yes* | 0.8 | 0.48 | 0.60 | 0.152 | Bad | Bad | Bad |

Yes* means with dividing wall (Considerations)

It was found from the results of Table 1 and Table 2 that, as compared with the conventional filters including all cells having a substantially square shape in cross section, the filters of the present invention having the cell cross-sectional structures shown in FIGS. 3 and 4 showed favorable results for all of the initial pressure loss, pressure loss during PM accumulation and crack limit. It was also found that, when the distance a shown in FIG. 3 and FIG. 5 was in the range of exceeding 0.8 mm and less than 2.4 mm and the value of distance b/distance a was in the range of exceeding 0.4 and less than 1.1, significant advantageous effects were obtained for both of the initial pressure loss and the pressure loss during PM accumulation in comparison with the case beyond these ranges.

A wall flow type exhaust gas purification filter according to the present invention is suitably used as a DPF to purify minute particles and noxious gas components contained in exhaust gas discharged from a direct-injection gasoline engine, a diesel engine and the like.

DESCRIPTION OF REFERENCE SYMBOLS

1: partition wall
2: cell
2*a*: inlet opening cell
2*b*: outlet opening cell
3: plugging portion
3*a*: inflow-side plugging portion
3*b*: outflow-side plugging portion
4: side
6*a*: inflow-side end face
6*b*: outflow-side end face
7: dividing wall
8: corners
9: honeycomb structure body
10, 100: wall flow type exhaust gas purification filter
11: first side
12: second side
13: third side
14: fourth side
a: distance a
b: distance b

What is claimed is:

1. A wall flow type exhaust gas purification filter, comprising:

a honeycomb structure body including a porous partition wall defining and forming a plurality of cells as through channels of a fluid, which extend from a first end face to a second end face, and plugging portions disposed at the first end face at a predetermined cell of the plurality of cells and at the second end face at remaining cell, wherein the plurality of cells include an inlet opening cell that is open at an inflow-side end face of the fluid and is provided with an outflow-side plugging portion at an outflow-side end face of the fluid; and an outlet opening cell that is provided with an inflow-side plugging portion at the inflow-side end face and is open at the outflow-side end face, the inlet opening cell has an apparently substantially hexagonal shape in cross section perpendicular to a central axis direction of the honeycomb structure body, the outlet opening cell has a substantially square shape in cross section perpendicular to the central axis direction of the honeycomb structure body, the plurality of cells are configured so that four inlet opening cells surround one outlet opening cell, where one predetermined side of an inlet opening cell and one side of the outlet opening cell adjacent to the predetermined side have a substantially same length and are substantially parallel to each other, distance a between the partition wall defining a first side of the outlet opening cell and the partition wall defining a second side opposed to the first side of the outlet opening cell is in a range of exceeding 0.8 mm and less than 2.4 mm, and distance b between the partition wall defining a third side of the inlet opening cell, the third side being substantially parallel and adjacent to one side of the outlet opening cell and the partition wall defining a fourth side opposed to the third side of the inlet opening cell has a ratio to the distance a in a range exceeding 0.4 and less than 1.1.

2. The wall flow type exhaust gas purification filter according to claim 1, wherein the inlet opening cell includes a dividing wall so as to connect a central part of the third side and a central part of the fourth side in a direction perpendicular to the central axis direction of the honeycomb structure body.

3. The wall flow type exhaust gas purification filter according to claim 1, wherein the inlet opening cell has a geometrical surface area GSA (a value (S/V) obtained by dividing an overall inner surface area (S) of the inlet opening cell by an overall capacity (V) of the honeycomb structure body) that is 10 to 30 $cm^2/cm^3$, the inlet opening cell has a cell cross-sectional opening ratio of 20 to 70%, and each of the plurality of cells has a hydraulic diameter of 0.5 to 2.5 mm.

4. The wall flow type exhaust gas purification filter according to claim 2, wherein the inlet opening cell has a geometrical surface area GSA (a value (S/V) obtained by dividing an overall inner surface area (S) of the inlet opening cell by an overall capacity (V) of the honeycomb structure body) that is 10 to 30 $cm^2/cm^3$, the inlet opening cell has a cell cross-sectional opening ratio of 20 to 70%, and each of the plurality of cells has a hydraulic diameter of 0.5 to 2.5 mm.

5. The wall flow type exhaust gas purification filter according to claim 1, wherein the inlet opening cell has a geometrical surface area GSA (a value (S/V) obtained by dividing an overall inner surface area (S) of the inlet opening cell by an overall capacity (V) of the honeycomb structure body) that is 12 to 18 $cm^2/cm^3$, the inlet opening cell has a cell cross-sectional opening ratio of 25 to 65%, and each of the plurality of cells has a hydraulic diameter of 0.8 to 2.2 mm.

6. The wall flow type exhaust gas purification filter according to claim 2, wherein the inlet opening cell has a geometrical surface area GSA (a value (S/V) obtained by dividing an overall inner surface area (S) of the inlet opening cell by an overall capacity (V) of the honeycomb structure body) that is 12 to 18 $cm^2/cm^3$, the inlet opening cell has a cell cross-sectional opening ratio of 25 to 65%, and each of the plurality of cells has a hydraulic diameter of 0.8 to 2.2 mm.

7. The wall flow type exhaust gas purification filter according to claim 3, wherein the inlet opening cell has a geometrical surface area GSA (a value (S/V) obtained by dividing an overall inner surface area (S) of the inlet opening cell by an overall capacity (V) of the honeycomb structure body) that is 12 to 18 $cm^2/cm^3$, the inlet opening cell has a cell cross-sectional opening ratio of 25 to 65%, and each of the plurality of cells has a hydraulic diameter of 0.8 to 2.2 mm.

8. The wall flow type exhaust gas purification filter according to claim 4, wherein the inlet opening cell has a geometrical surface area GSA (a value (S/V) obtained by dividing an overall inner surface area (S) of the inlet opening cell by an overall capacity (V) of the honeycomb structure body) that is 12 to 18 $cm^2/cm^3$, the inlet opening cell has a cell cross-sectional opening ratio of 25 to 65%, and each of the plurality of cells has a hydraulic diameter of 0.8 to 2.2 mm.

9. The wall flow type exhaust gas purification filter according to claim 1, wherein the plurality of cells each have corners of a cross section perpendicular to the central axis direction of the honeycomb structure body, the corners having a curved shape with a curvature radius of 0.05 to 0.4 mm.

10. The wall flow type exhaust gas purification filter according to claim 2, wherein the plurality of cells each have corners of a cross section perpendicular to the central axis direction of the honeycomb structure body, the corners having a curved shape with a curvature radius of 0.05 to 0.4 mm.

11. The wall flow type exhaust gas purification filter according to claim 3, wherein the plurality of cells each have corners of a cross section perpendicular to the central axis direction of the honeycomb structure body, the corners having a curved shape with a curvature radius of 0.05 to 0.4 mm.

12. The wall flow type exhaust gas purification filter according to claim 4, wherein the plurality of cells each have corners of a cross section perpendicular to the central axis direction of the honeycomb structure body, the corners having a curved shape with a curvature radius of 0.05 to 0.4 mm.

13. The wall flow type exhaust gas purification filter according to claim 5, wherein the plurality of cells each have corners of a cross section perpendicular to the central axis direction of the honeycomb structure body, the corners having a curved shape with a curvature radius of 0.05 to 0.4 mm.

14. The wall flow type exhaust gas purification filter according to claim 6, wherein the plurality of cells each have corners of a cross section perpendicular to the central axis direction of the honeycomb structure body, the corners having a curved shape with a curvature radius of 0.05 to 0.4 mm.

15. The wall flow type exhaust gas purification filter according to claim 7, wherein the plurality of cells each have corners of a cross section perpendicular to the central axis direction of the honeycomb structure body, the corners having a curved shape with a curvature radius of 0.05 to 0.4 mm.

16. The wall flow type exhaust gas purification filter according to claim 8, wherein the plurality of cells each have corners of a cross section perpendicular to the central axis direction of the honeycomb structure body, the corners having a curved shape with a curvature radius of 0.05 to 0.4 mm.

17. The wall flow type exhaust gas purification filter according to claim 1, wherein the partition wall defining the plurality of cells is loaded with catalyst.

* * * * *